US007806097B2

(12) United States Patent
Kellermann

(10) Patent No.: US 7,806,097 B2
(45) Date of Patent: Oct. 5, 2010

(54) STARTER DEVICE FOR A MOTOR DRIVEN MACHINE

(75) Inventor: Christian Kellermann, Stapelfeld (DE)

(73) Assignee: DOLMAR GmbH, Hamburg (DE)

( * ) Notice: Subject to any disclaimer, the term of this patent is extended or adjusted under 35 U.S.C. 154(b) by 0 days.

(21) Appl. No.: 12/115,135

(22) Filed: May 5, 2008

(65) Prior Publication Data

US 2008/0276735 A1 Nov. 13, 2008

(30) Foreign Application Priority Data

May 8, 2007 (DE) ..... 20 2007 006 551 U
Jan. 4, 2008 (DE) ..... 20 2008 000 186 U

(51) Int. Cl.
*F02N 1/00* (2006.01)

(52) U.S. Cl. ..... 123/185.3

(58) Field of Classification Search ..... 74/6–9; 242/254; 123/185.3, 185.2
See application file for complete search history.

(56) References Cited

U.S. PATENT DOCUMENTS 2,942,599 A * 6/1960 Irgens ..... 123/185.3
4,019,490 A * 4/1977 Reese ..... 123/185.2
5,118,978 A * 6/1992 Matsumoto et al. ..... 123/185.2
5,287,832 A * 2/1994 Uhl ..... 123/185.3
6,212,967 B1 * 4/2001 Nugent ..... 74/437

* cited by examiner

*Primary Examiner*—Thomas R Hannon
*Assistant Examiner*—Phillip A Johnson
(74) *Attorney, Agent, or Firm*—Kelly Lowry & Kelly, LLP; Scott W. Kelley

(57) ABSTRACT

The invention pertains to a device for starting an internal combustion engine for handheld equipment such as chain saws, lawn mowers, lawn trimmers and the like, or for vehicles such as mopeds, boats or miniature aircraft. The starting device features an output element into which a starter torque can be introduced when the starting device is actuated. The output element is functionally connected to a crankshaft of the internal combustion engine in order to introduce a crankshaft torque therein. The functional connection between the output element and the crankshaft introduces variable crankshaft torque into the crankshaft depending on the rotational angle of the crankshaft at a constant starter torque. This advantageously improves force or torque characteristics for largely operating the starter device independently of the compression phase and the expansion phase of the internal combustion engine.

8 Claims, 14 Drawing Sheets

STARTER DEVICE FOR A MOTOR DRIVEN MACHINE

The present invention pertains to a starter device for starting an internal combustion engine as it is used, in particular, for handheld equipment, chain saws, lawn mowers, lawn trimmers and the like or an internal combustion engine for vehicles, particularly mopeds, boats or miniature aircraft. Such starter devices comprise an output element that may be realized in the form of a rotating shaft or a flange, into which a starter torque is introduced when the starter device is actuated, wherein the output element is functionally connected to the crankshaft of the internal combustion engine in order to introduce a crankshaft torque for starting the engine into the crankshaft. The starter device may be manually operated, wherein manually operated starter devices are usually provided with a pull rope, on the end of which a handle is arranged. Pulling on the pull rope causes a rope spool to be set in rotation, wherein the output element is only connected to the crankshaft while the starter device is actuated in order to introduce a torque therein. There also exist starter devices that are operated by means of an electric motor, but these starter devices also feature an output element, by means of which a crankshaft torque is introduced into the crankshaft. There furthermore exist starter devices in the form of a combination of a manually operated device and a device with an electric motor. In this case, the internal combustion engine can be selectively started by pulling on a handle or by means of the electric motor. Another existing type of starter device only features an electric motor in the form of an E-starter.

There also exist different other types of mechanical, hydraulic or pneumatic starter devices. All known starter devices realize the basic principle of introducing a starting torque that is transmitted to the crankshaft of the internal combustion engine. For example, the kick starter of motorcycle engines or an independent (small) internal combustion engine for starting another (larger) internal combustion engine may also be considered a starter device in the sense of the invention.

STATE OF THE ART

DE 41 35 405 A1 describes a starter device for manually starting an internal combustion engine that essentially consists of a rope spool that is actuated by means of a pull rope and able to set a crankshaft in rotation by means of a locking gear. Due to the constructive design of the internal combustion engine, the crankshaft generally has a periodically changing torque characteristic during its rotational movement, wherein this torque characteristic depends on whether the internal combustion is realized in the form of a two-stroke engine or a four-stroke engine. A high torque is required during the compression phase of the internal combustion engine while the rotational movement of the crankshaft may even lead the rotational movement of the starter device in the expansion phase. This highly periodic torque demand of the internal combustion engine to be started generates a force in the pull rope that increases and decreases in a correspondingly periodic fashion and needs to be overcome by the user who perceives this force as an abrupt load. For example, in a single-cylinder two-stroke cut-off saw with a displacement of 73 $cm^3$, a rope force with a peak value of 550 N can be generated. This represents a substantial load to be overcome by the user. It has been proposed to realize a coupling drum and a carrier in the locking mechanism as independent components, between which an elastically deformable tappet is arranged in order to absorb the peak forces of the reaction torque. However, a very high force may also be required for setting the starter device in rotation at the beginning of the starting process depending on the piston position of the internal combustion engine. Consequently, an elastically deformable tappet that is realized, for example, in the form of a coil spring cannot substantially smooth out the periodic pull rope force. Furthermore, the rope spool is directly coupled to the crankshaft rotationally such that the rope spool needs to have the same speed as the crankshaft during the starting process. Even the slight difference in speed made possible by the elastically deformable tappet results in a slight deviation between the speed of the crankshaft and the speed of the rope spool.

DE 102 55 838 A1 describes another starter device for an internal combustion engine that may selectively feature an electric starter, a reversing starter or a combination of an electric starter and a reversing starter that can be arbitrarily interchanged. In this starter device, the electric motor can be connected to the crankshaft of the internal combustion engine by means of a gear, wherein the gear disclosed in this publication has a fixed step-up or step-down ratio between the reversing starter or electric starter and the crankshaft of the internal combustion engine. The gear therefore also directly transmits the periodically changing torque demand of the internal combustion engine to the pull rope operated by the user.

DISCLOSURE OF THE INVENTION, PROBLEM DEFINITION, SOLUTION, ADVANTAGES

The present invention therefore is based on the objective of developing a starter device for starting an internal combustion engine that has an improved force or torque characteristic in order to largely operate the starter device independently of the compression phase and the expansion phase of the internal combustion engine.

Based on a starter device according to the preamble of claim 1, this objective is attained in connection with the characteristics disclosed in the characterizing portion of this claim. Practical additional developments of the invention are disclosed in the dependent claims.

The invention involves the technical characteristic of realizing the functional connection between the output element and the crankshaft in such a way that the crankshaft torque introduced into the crankshaft is variable at a constant starter torque.

The invention is based on the notion of realizing the functional connection between the output element and the crankshaft in such a way that a step-up or step-down ratio is created that changes in dependence on the rotational angle of the crankshaft. The significant periodic fluctuations of the load in the starter device can only be overcome with a step-up or step-down ratio that is related to the rotational angle of the crankshaft. The term functional connection generally refers to the mechanical coupling between the output element and the crankshaft, wherein the term output element describes, depending on the design of the starter device in the form of a manually operated starter device or an electrically operated starter device, the rotating element that is acted upon either manually or by means of an electric motor in order to generate a rotational movement. Consequently, the inventive solution of the functional connection between the output element and the crankshaft is not strictly limited to manually operated starter devices, but may also describe an improved torque characteristic for an electric motor, for example, in order to realize this electric motor with smaller dimensions if lower maximum torques are required.

The inventive functional connection between the output element and the crankshaft is suitable for use in single-cylinder engines that operate in accordance with the two-stroke principle and the four-stroke principle. Consequently, the partial change of the transmission ratio therefore refers to a periodic repetition during a single revolution in a two-stroke engine while a change takes place during two revolutions in a four-stroke engine. Consequently, the inventive idea basically consists of overcoming the compression stroke, during which a torque increase is achieved, while an excessive rotational speed of the output element caused by the crankshaft of the internal combustion engine after the compression stroke should be prevented after overcoming the top dead center.

The inventive functional connection is also suitable for use in two-stroke or four-stroke multicylinder engines. In this case, the change of the crankshaft torque depends on the number of cylinders, the engine type (in-line engine, boxer engine, V-type engine, etc.) and the ignition sequence.

One possible embodiment of the starter device pertains to a manually operated starter device that comprises a handle, a starter pulling means arranged thereon and a pulling means spool for winding up and for unwinding the starter pulling means in order to (indirectly) introduce the starter torque into the crankshaft of the internal combustion engine. In the idle state of the starter device, the pulling means are wound up on the pulling means spool such that it is merely required to introduce a pulling force into the starter pulling means via the handle when the starter device is actuated in order to unwind the pulling means from the pulling means spool. This causes the pulling means spool to carry out a rotational movement and a starter torque to be introduced therein. This starter torque is now transmitted into the crankshaft of the internal combustion engine by means of the inventive functional connection in the form of a variable crankshaft torque.

According to a first embodiment of the inventive starter device, the output element is formed by the pulling means spool itself, wherein a gear unit arranged between the pulling means spool and the crankshaft transmits the starter torque of the pulling means spool to the crankshaft with a variable step-up or step-down ratio that is dependent on the rotational angle of the crankshaft. This embodiment describes a manually operated starter device, wherein the varying step-up or step-down ratio is varied by the gear unit itself in dependence on the rotational angle of the crankshaft. If the starter pulling means are subjected to a uniform pulling motion, the pulling means spool carries out an equally uniform rotational movement. The crankshaft torque that periodically changes as a function of the rotational angle of the crankshaft is compensated by the step-up or step-down ratio in the gear unit such that the starter torque generated by means of the pulling means spool is approximately uniform. The significantly swelling load in the starter pulling means therefore no longer occurs because the periodically changing step-up or step-down ratio results in a smoothing effect.

It is therefore advantageous if a low transmission ratio is adjusted in the gear unit during the compression stroke of the internal combustion engine and a high transmission ratio is adjusted in the gear unit during the expansion stroke of the internal combustion engine. This needs to be correspondingly adapted to the design of the internal combustion engine in the form of a two-stroke engine or a four-stroke engine. In this case, it is preferred that the transmission ratio of two-stroke engines respectively changes in the same fashion during one revolution of the crankshaft while the change of the transmission ratio respectively takes place during two revolutions of the crankshaft in four-stroke engines.

According to the invention, a possible first embodiment of the gear unit is characterized in that it is realized in accordance with a double crank mechanism. A double crank mechanism usually comprises a first and a second crank element, wherein a coupling rod is arranged between the ends of the crank elements in order to transmit the rotational movement of the first crank element to the second crank element. The two crank elements are arranged offset relative to one another, wherein one crank element is driven and the driving motion is introduced into the second crank element by means of the coupling rod. If the first crank element is driven with a uniform rotational movement, the second crank element carries out a movement that is unevenly accelerated and decelerated over the circumference. Consequently, the torque in the second crank element that is inversely proportional to the rotational speed of the second crank element changes during the course of one full revolution of the first crank element. The double crank mechanism according to the invention is arranged between the output element of the starter device and the crankshaft of the internal combustion engine in order to adjust the desired step-up or step-down ratio between the output element and the crankshaft.

According to the invention, the first crank element is formed by the pulling means spool with a hinge pin arranged on the plane side which rotates about a spool axis, wherein the second crank element is realized in the form of a lever arm that is supported in a receptacle bridge such that it is rotatable about an output axis that is offset relative to the spool axis. However, the output axis may also coincide with the rotational axis of the crankshaft of the internal combustion engine. The hinge pin arranged on the plane side of the pulling means spool is positioned eccentrically and carries out a rotational movement about the spool axis due to the rotation of the pulling means spool. The coupling rod extends between the hinge pin on the pulling means spool and another hinge pin that is arranged on the protruding side of the lever arm. According to the invention, the structure consisting of the pulling means spool, the coupling rod and the lever arm corresponds to the double crank mechanism, wherein the lever arm rotates about the output axis and is connected to the crankshaft by means of a coupling.

It is furthermore advantageous that the starter device comprises a receptacle plate, on which at least the pulling means spool and the receptacle bridge are accommodated and which forms the base body of the starter device. In this case, two spacer elements extend between the receptacle plate and the receptacle bridge, wherein the pulling means spool is arranged between the receptacle plate and the receptacle bridge and the spacer elements are laterally guided along the pulling means spool. Due to the accommodation of the components on the receptacle plate, a compact unit is formed, wherein the spacer elements are realized in the form of cylindrical rods, and wherein the receptacle bridge extends transverse to the receptacle plate and is screwed to the receptacle plate with the rod-like spacer elements. This results in a frame of sorts, in which the components of the double crank mechanism are accommodated.

The lever arm advantageously is rotatably supported in that it extends through the receptacle bridge with a bearing section, wherein a coupling member is arranged in a rotationally rigid fashion on the end of the bearing section that protrudes from the receptacle bridge. The receptacle bridge therefore serves for rotatably accommodating the lever arm and the coupling member, and the lever arm comprises a cylindrical section that forms the bearing section of the lever arm extending through the receptacle bridge. For this purpose, the receptacle bridge features a bore such that the cylindrical bearing section of the lever arm forms a sliding bearing together with the bore in the receptacle bridge.

According to another embodiment of the coupling member, the coupling member and the lever arm are realized in the form of a one-piece disk element that is arranged plane-parallel to the pulling means spool and supported on a bearing journal that is arranged on the receptacle plate offset to the spool axis of the pulling means spool, namely such that it is rotatable about a coupling member axis. In this case, a bearing section of the pulling means spool concentrically extends around the spool axis between the bearing journal and the receptacle plate in order to rotatably arrange the pulling means spool on the receptacle plate, wherein the spool axis and the coupling member axis are offset relative to one another. The effect of a double crank mechanism can only be achieved with this offset, wherein the simultaneous arrangement of the pulling means spool on the inner side and of the disk element on the receptacle plate allows a compact construction as well as a simple design of the starter device.

According to one advantageous additional development of the disk element, it comprises a hinge pin such that the coupling rod can extend between the hinge pin of the pulling means spool and the hinge pin on the disk element. The hinge pins form an integral part of the respective components, wherein one preferred manufacture of these components may consist of an injection moulding process in the form of a plastic injection moulding process or an aluminum die casting process.

The inventive arrangement of the receptacle plate, the pulling means spool, the disk element or the lever arm and the other elements forming the double crank mechanism results in a separable structural unit of the starter device. This structural unit can be modularly adapted to different applications of an internal combustion engine, wherein it is also possible to realize a module-like variation of the starter device that can be adapted to a two-stroke engine or a four-stroke engine. The interface of the starter device to be adapted merely consists of the dependence of the step-up or step-down ratio on the full revolution of the coupling member, wherein the coupling member itself also needs to be adapted to the downstream coupling or the crankshaft, respectively.

The coupling member is designed for producing a separable and torque-resistant connection with the crankshaft of the internal combustion engine, wherein a torsion spring arranged between the coupling member and the crankshaft prevents the decoupling of the crankshaft from the coupling member while the internal combustion engine is started. Depending on the ratio between the generated starter torque or starter speed of the output element and the speed of the crankshaft of the internal combustion engine, the crankshaft may briefly disengage during the expansion phase due to the mass moment of inertia of the engine. In this case, the crankshaft of the internal combustion engine briefly rotates faster than the coupling member of the starter device such that the overrunning clutch disengages. This is the reason why the invention proposes to utilize a torsion spring with a limit stop that is prestressed when the starter device is actuated and thusly prevents such a disengagement. The spring ensures that the coupling side of the starter device follows the crankshaft that is accelerated during the expansion phase and thusly remains engaged. The limit stop of the torsion spring protects the torsion spring from overloads and defines the angle of engagement.

According to another advantageous embodiment of the double crank mechanism, the coupling rod is realized in the form of an elastically bendable coupling element. This coupling element has a horseshoe-shaped structure with an elastically bendable region such that the coupling element is shortened under a pressure load between the ends that form the hinges. If a higher torque is transmitted to the crankshaft of the internal combustion engine by means of the double crank mechanism, the effective length of the coupling rod is shortened and the spacing between the hinge pins on the pulling means spool and on the disk element or on the lever arm, respectively, is reduced. This lowers the transmission ratio and a higher torque can be transmitted to the crankshaft, wherein the effect of reducing the required force to be introduced into the starter pulling means with the aid of the handle is simultaneously achieved. This results in a smoothing effect of the periodically fluctuating pulling force.

It is advantageous to respectively realize the ends of the elastically bendable coupling element that form the hinges with hinge pin bores, in which the hinge pins are accommodated. The elastically bendable coupling element furthermore has a limit stop geometry in order to limit the elastic deformation of the elastically bendable region. This prevents the elastically bendable coupling element from being overloaded because the limit stop geometry is realized in such a way that no plastic deformation takes place in the elastic region. The elastically bendable coupling element therefore acts as a pressure spring that is shortened under a load. This makes it possible to significantly increase the force at the beginning of the starting process while the coupling rod is compressed under a load during the compression phase of the internal combustion engine. Once the concentricity improves after a few revolutions due to the engine flywheel mass, the coupling rod is once again elongated. In this case, the horseshoe-shaped design allows a favorable realization of the elastically bendable region, wherein the coupling element could also have the shape of a U, the shape of a spiral or another geometric shape. Due to this geometric design of the coupling element, the gear automatically adapts to the torque characteristic.

According to an advantageous additional development of the invention, it is proposed that the internal combustion engine features a crankshaft flange that is connected to the crankshaft, and that a ratchet coupling with at least two ratchet elements is arranged between the crankshaft flange and the coupling member. The crankshaft flange is arranged on the end of the crankshaft and comprises two ratchet elements that are arranged opposite of one another on the plane side of the crankshaft flange and have a different height referred to the plane side such that the ratchet elements are able to engage into assigned engagement windows in the coupling member at the respective height. Two oppositely arranged ratchet elements provide the advantage that no additional bearing forces are generated because lateral forces would be generated if only one ratchet element is used. However, the two ratchet elements form a force couple such that the rotational movement can be transmitted to the crankshaft flange without any lateral forces. In order to provide only one engagement option, it is proposed that the ratchet elements are offset relative to one another along the spool axis by a few millimeters at the height of the plane side. Analogously, the engagement windows in the coupling member are positioned differently along the output axis by the same offset. This ensures that the ratchet elements are able to engage into the respectively assigned engagement window such that the rotational movement can only be transmitted in a single defined angular position of the coupling member relative to the crankshaft flange. It is therefore ensured that the step-up or step-down ratio realized in the gear unit corresponds to the compression or expansion phase of the internal combustion engine.

Another embodiment of the coupling between the output element and the crankshaft flange can be realized with a centrifugal clutch with a centrifugal element, wherein the centrifugal element acts as a coupling rod in order to produce a functional connection of the double crank mechanism type between the crankshaft flange and the output element. The above-described function of the double crank mechanism is realized to its full extent in this case, wherein the double crank mechanism simultaneously serves as a coupling such that the centrifugal element can come to rest in a stopping device, in which it is held by means of the acting centrifugal force, when the internal combustion engine starts.

According to another embodiment of the coupling between the pulling means spool and the crankshaft flange, a friction ring and a roll element are arranged therebetween, wherein the friction ring and the roll element cooperate in such a way that a torque is transmitted when the starter device is actuated and the transmission of this torque is not interrupted until the internal combustion engine starts. Several roll tracks that are arranged on the plane side of the engaging element and point in the direction of the crankshaft flange make it possible for one respective assigned roll element to roll along a radially curved track. The radially curved roll track cooperates with the quick-acting screw thread for the axial offset of the engaging element in such a way that the desired functional connection with variable transmission ratio is achieved between the output element and the crankshaft. The pulling means spool is accommodated on the receptacle plate by means of a shaft-like receptacle bolt, wherein the engaging element is simultaneously accommodated in the pulling means spool itself by means of the quick-acting screw thread. The unit consisting of the engaging element, the pulling means spool and the friction ring is axially screwed to the cylinder-like receptacle axis of the receptacle plate by means of a central screw plug.

Possible embodiments of the starter pulling means and the pulling means spool consist of a pull rope, a pull chain or a pull band with an assigned rope spool or band spool, wherein the rope or the band forms layers that lie on top of one another on the spool. Due to these measures, a continuously variable step-up transmission ratio that promotes the starting process is realized upstream of the variable gear in the form of a serial connection. At the beginning of the starting process, numerous layers lie on top of one another on the pulling means spool such that a high torque is introduced with a low speed. As the pulling means are unwound, the torque introduced into the spool decreases and the rotational speed of the spool simultaneously increases. This also corresponds to the torque and speed requirements for starting the engine. Naturally, it would also be possible to realize multi-track pulling means spools.

In addition to the utilization of a double crank mechanism, it is also possible to realize the gear unit in the form of a gearing with variable transmission ratio. Out-of-round gearwheel transmission characteristics allow a largely free design such that a transmission ratio that is adapted to the engine can be realized. The gearwheels are eccentrically supported such that the speed of the driven gearwheel periodically changes at a uniform rotational speed of the driving gearwheel. The gearwheels can be cost-efficiently manufactured with a rough gearing of sheet metal, for example, by means of laser beam cutting or a precision blanking method. The gearing consists of an out-of-round gearing with at least one first eccentric gearwheel and one second eccentric gearwheel in order to form an intermeshing gearwheel pair. One advantageous additional development of the gearing with variable transmission ratio consists of a double out-of-round gearing with a second gearwheel pair that comprises at least two out-of-round gearwheels that are arranged coaxially to one another. Two gearwheel pairs allow a coaxial construction such that the installation position of the starter device does not have to be offset relative to the direction, in which the crankshaft extends. Furthermore, a multiplied transmission with several free transmission zones is realized.

Another embodiment of the gear unit may also be realized in accordance with a revolving slider crank gear.

A continuative embodiment of the inventive starter device has a gearless design with a pulling means spool that has an out-of-round, elliptical or cam-like contour for winding up and unwinding the starter pull rope. Due to these measures, the functional radius changes during the rotational movement of the pulling means spool and can be adapted to the torque demand for starting the internal combustion engine. When the starter pulling means are uniformly unwound, the pulling means spool rotates with a variable speed, wherein a variable crankshaft torque can be introduced into the crankshaft depending on the rotational angle of the crankshaft. However, it would also be possible to realize a combination of such a pulling means spool and a downstream gear.

An additional development of the inventive starter device may be realized with an electric motor for introducing the starter torque into the output element. An advantageous embodiment of the inventive design of the functional connection between the output element and the crankshaft is also achieved with the utilization of an electric motor because the electric motor can be realized smaller if the maximum torques in dependence on the crankshaft angle become smaller. Since a uniform torque demand results for an electric motor, an adaptation of the electric motor to the starter device is simplified.

BRIEF DESCRIPTION OF THE FIGURES

Other measures that improve the invention are explained in greater detail below in connection with the description of different embodiments of the invention that refers to the figures. The purely schematic figures show.

BEST WAY FOR REALIZING THE INVENTION

Figure 1:
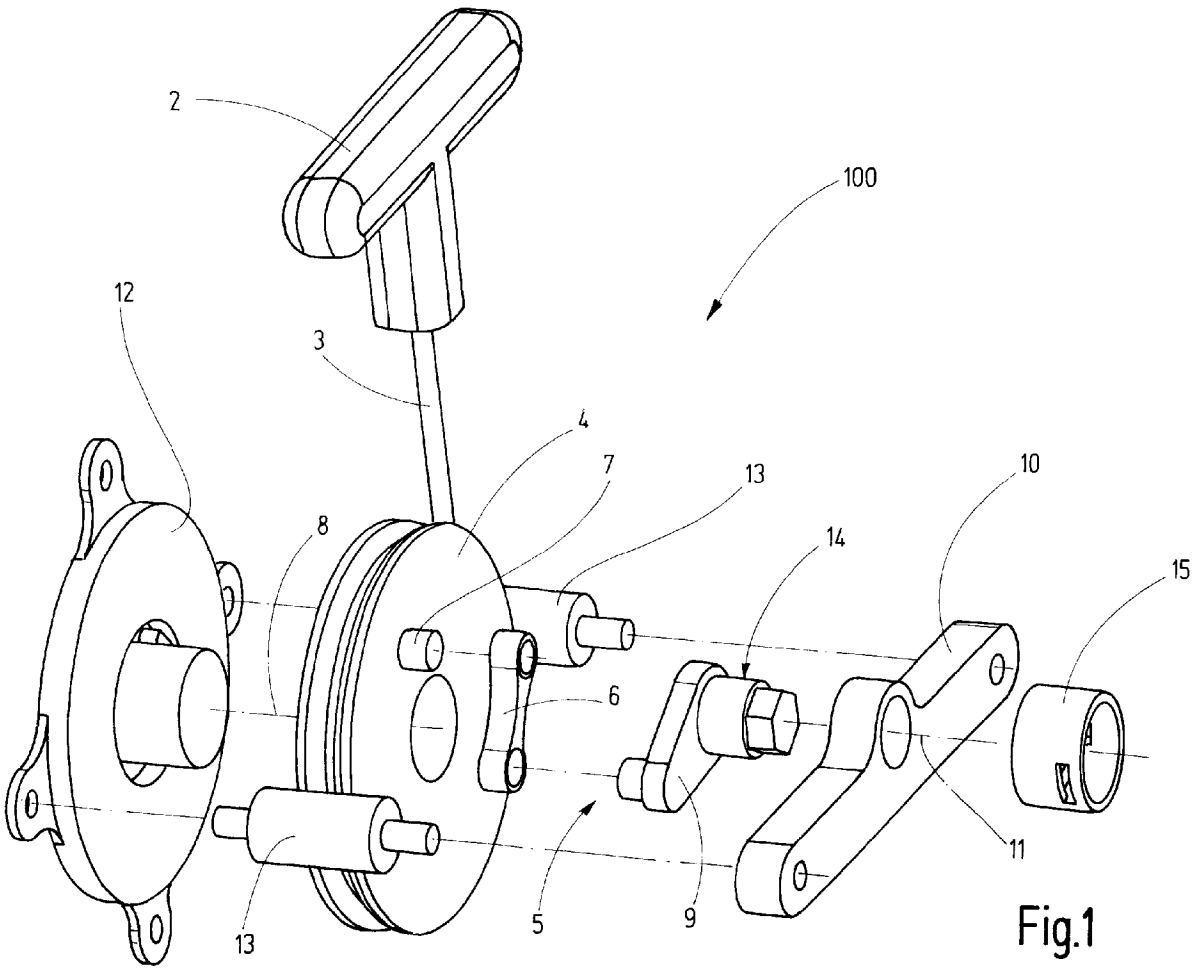
FIG. 1, an exploded view of the starter device with a first embodiment of the inventive double crank mechanism.

FIG. 1 shows a starter device that is identified by the reference symbol 100. The starter device 100 comprises a handle 2 that enables the user to introduce a pulling force into a starter pulling means 3. The starter pulling means 3 are realized in the form of a rope and wound up on a pulling means spool 4 in the form of a rope spool. If the user pulls on the starter pulling means 3, the pulling means spool 4 is set in rotation due to the unwinding of the starter pulling means 3 from the pulling means spool 4 such that a starter torque is introduced. The rotation of the pulling means spool 4 is transmitted to a coupling member 15, wherein the transmission is realized by means of a double crank mechanism 5.

The double crank mechanism 5 comprises a coupling rod 6 that is arranged between a hinge pin 7 situated on the plane side of the pulling means spool 4 and a lever arm 9. The rotational movement of the pulling means spool 4 causes the hinge pin 7 to rotate about a spool axis 8, wherein the lever arm 9 is supported such that it is rotatable about an output axis 11 that is offset relative to the spool axis 8. The rotational movement of the pulling means spool 4 is transmitted into the lever arm 9 by means of the coupling rod 6 such that the lever arm carries out a non-uniform movement relative to the rotational movement of the pulling means spool 4. If the pulling means spool 4 carries out a uniform rotational movement, the lever arm 9 rotates slowly over one segment of a circle and rapidly over another segment of a circle during one full revolution of the pulling means spool 4. This makes it possible to realize a conversion of the torque that is adapted to the torque demand for starting the internal combustion engine.

The pulling means spool 4 is rotatably supported on a receptacle plate 12 while the lever arm 9 comprises a bearing section 14 that extends through a receptacle bridge 10 in order to be supported. The receptacle bridge 10 is mounted on the receptacle plate 12 by means of spacer elements 13, wherein the receptacle bridge 10 extends similar to a beam and features a screw connection with one respective spacer element 13 on its ends. A coupling member 15 is arranged on the end of the lever arm 9 that extends through the receptacle bridge 10 such that the rotational movement of the lever arm 9 about the output axis 11 is transmitted into the coupling member 15. All in all, the starter device 100 thusly makes it possible to generate a periodically changing rotational movement in the coupling member 15 when the starter pulling means 3 are subjected to a uniform pulling motion.

Figure 2:
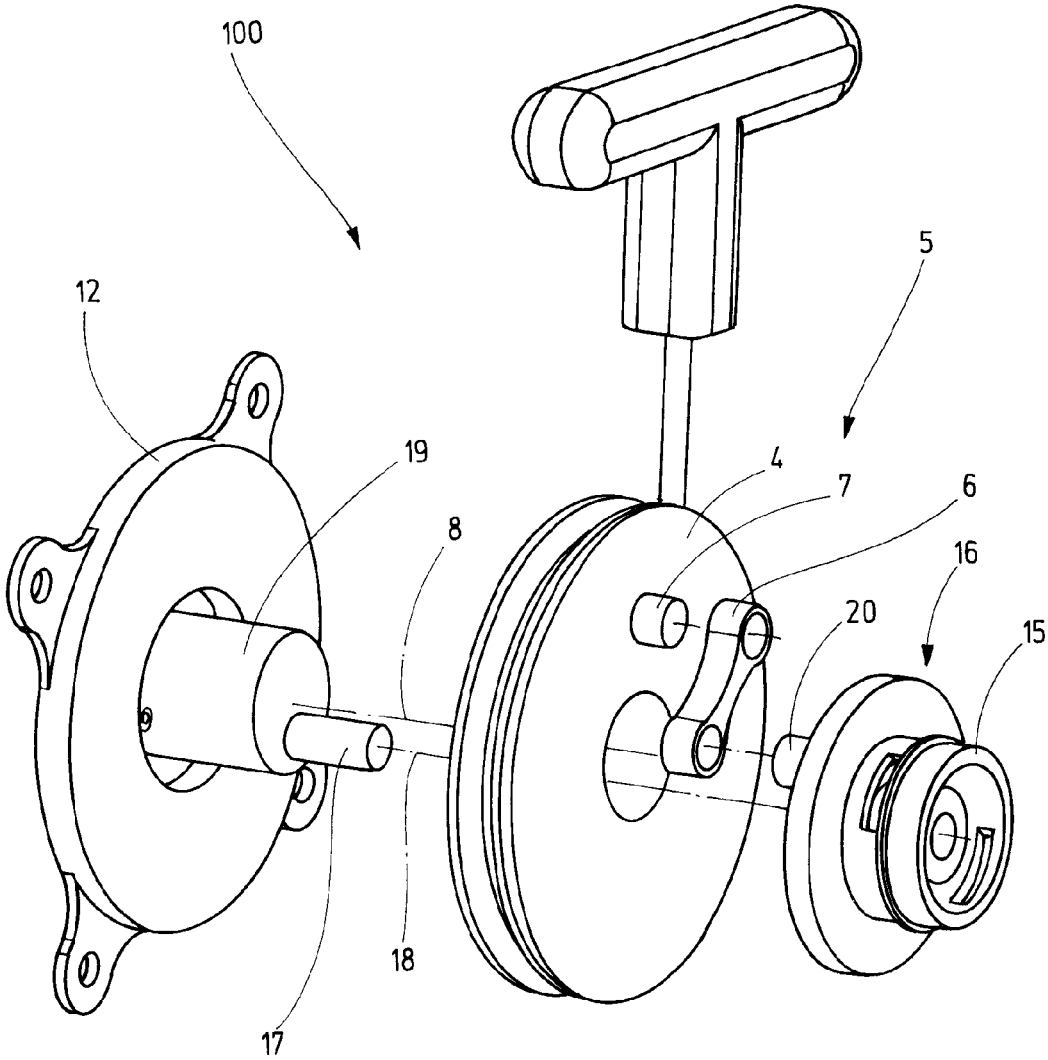
FIG. 2, an exploded view of the starter device with another embodiment of the inventive double crank mechanism.

FIG. 2 shows another embodiment of the inventive double crank mechanism 5 in the starter device 100. An end of the coupling member 15 is moulded onto a disk element 16, wherein the disk element 16 is rotatably accommodated on a bearing journal 17 and the bearing journal 17 is arranged in the receptacle plate 12. A pulling means spool section 19, on which the pulling means spool 4 is rotatably supported, extends between the bearing journal 17 and the receptacle plate 12. The bearing journal 17 extends along a coupling member axis 18 that is offset relative to the spool axis 8. Consequently, the bearing journal 17 is arranged eccentrically on the pulling means spool section 19 in order to realize the offset of the crank elements required for the double crank mechanism 5. The first crank element of the double crank mechanism 5 is formed by the pulling means spool 4 with a hinge pin 7 arranged on its plane side and rotates about the spool axis 8, wherein the second crank element is formed by the disk element 16 and the coupling rod 6 extends between the hinge pin 7 and another hinge pin 20 arranged on the disk element 16. This simplifies the arrangement because the lever arm 9 (see FIG. 1) and the coupling member 15 are realized in the form of a one-piece disk element 16.

Figure 3:
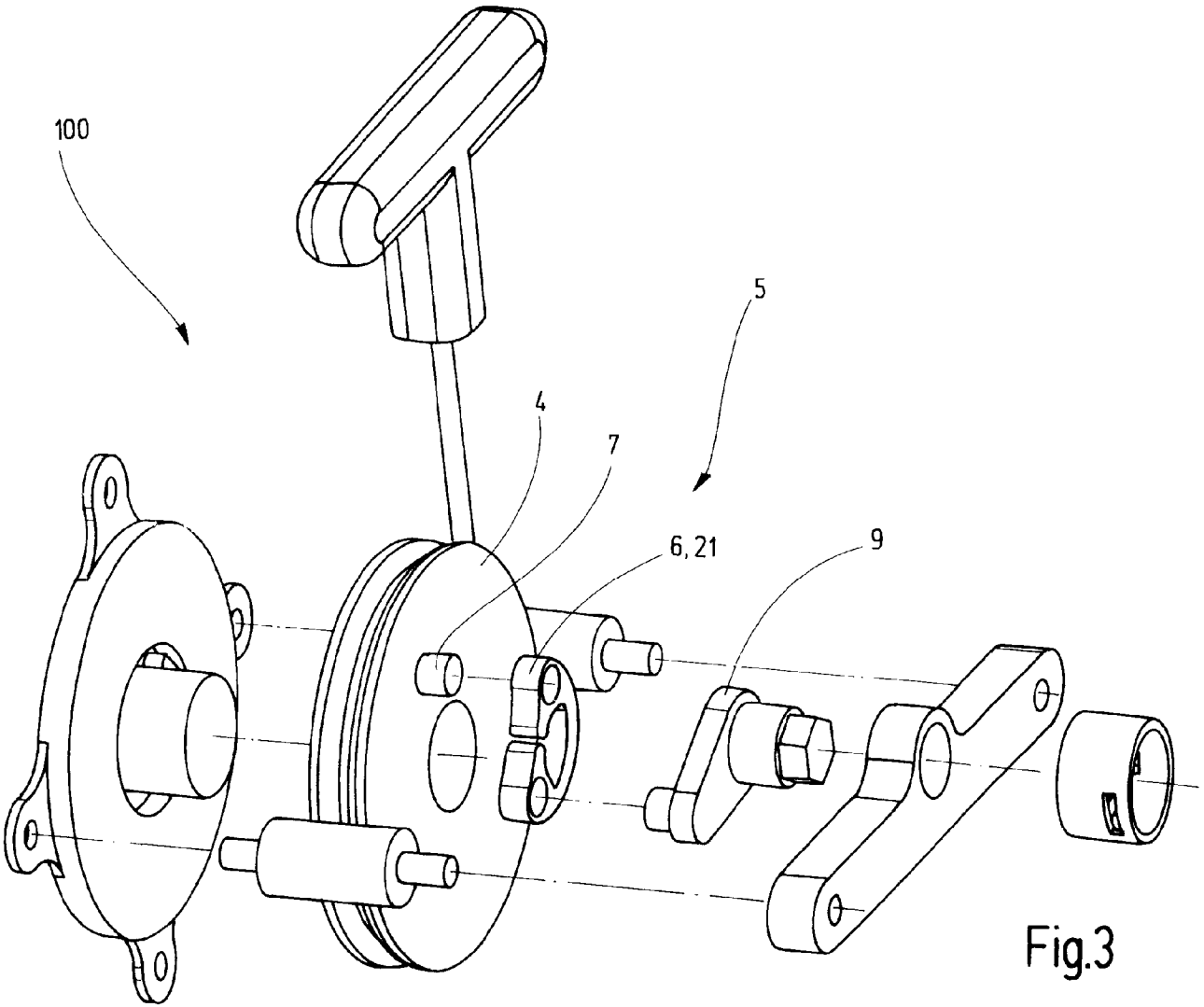
FIG. 3, an exploded view of the starter device with a double crank mechanism, wherein this mechanism comprises a coupling rod that is realized in the form of an elastically bendable coupling element.

FIG. 3 shows an advantageous additional development of the double crank mechanism 5 of the starter device 100. This double crank mechanism comprises a coupling rod 6 that is realized in the form of an elastically bendable coupling element 21. The elastically bendable coupling element 21 is rotatably inserted between the hinge pin 7 and the lever arm 9 and able to change its effective length due to the bending elasticity. If a torque is applied to the double crank mechanism 5 by means of the pulling means spool 4 and the hinge pin 7, the elastically bendable coupling element 21 bends such that its defective length is shortened and the torque transmitted to the lever arm 9 increases. If the load on the elastically bendable coupling element 21 is alleviated, its effective length once again increases such that the rotational speed of the lever arm 9 increases once again as the torque decreases.

Figure 4:
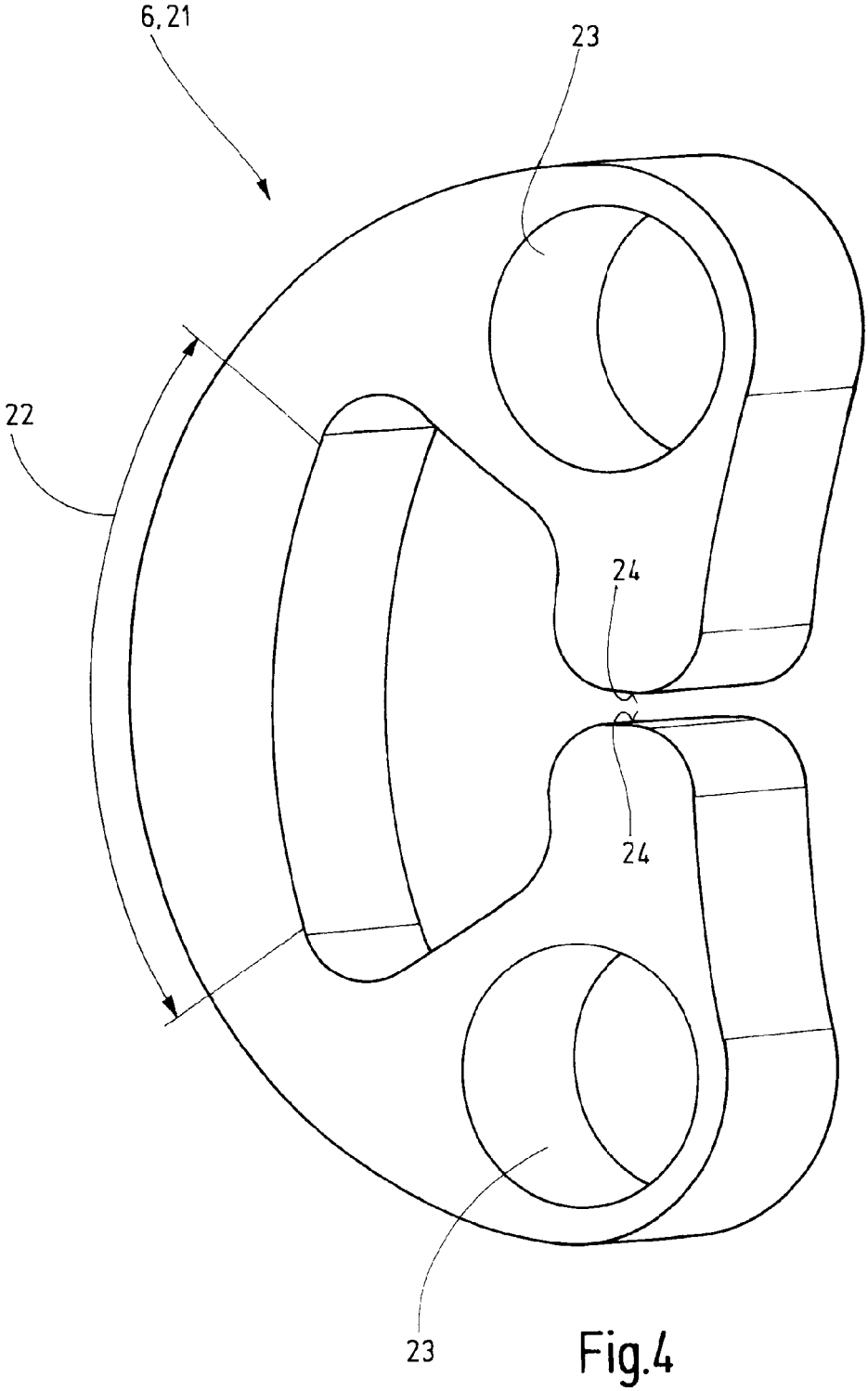
FIG. 4, a perspective representation of the elastically bendable coupling element according to the embodiment shown in FIG. 3.

FIG. 4 shows a perspective representation of the elastically bendable coupling element 21 that takes over the function of the coupling rod 6. The elastically bendable coupling element 21 has a horseshoe-shaped structure and comprises two hinge pin bores 23, through which the hinge pins (hinge pins 7, 20; see FIG. 2) extend and respectively form a sliding bearing. The elastically bendable region 22 is realized between the ends of the horseshoe-shaped coupling element 21 such that the distance between the hinge pin bores 23 can be increased and decreased. A limit stop geometry 24 is provided for limiting the bending within the elastically bendable region 22. If the bending load becomes excessively high, the surfaces of the limit stop geometries 24 respectively contact one another such that the additional bending of the elastically bendable region 22 is limited.

Figure 5:
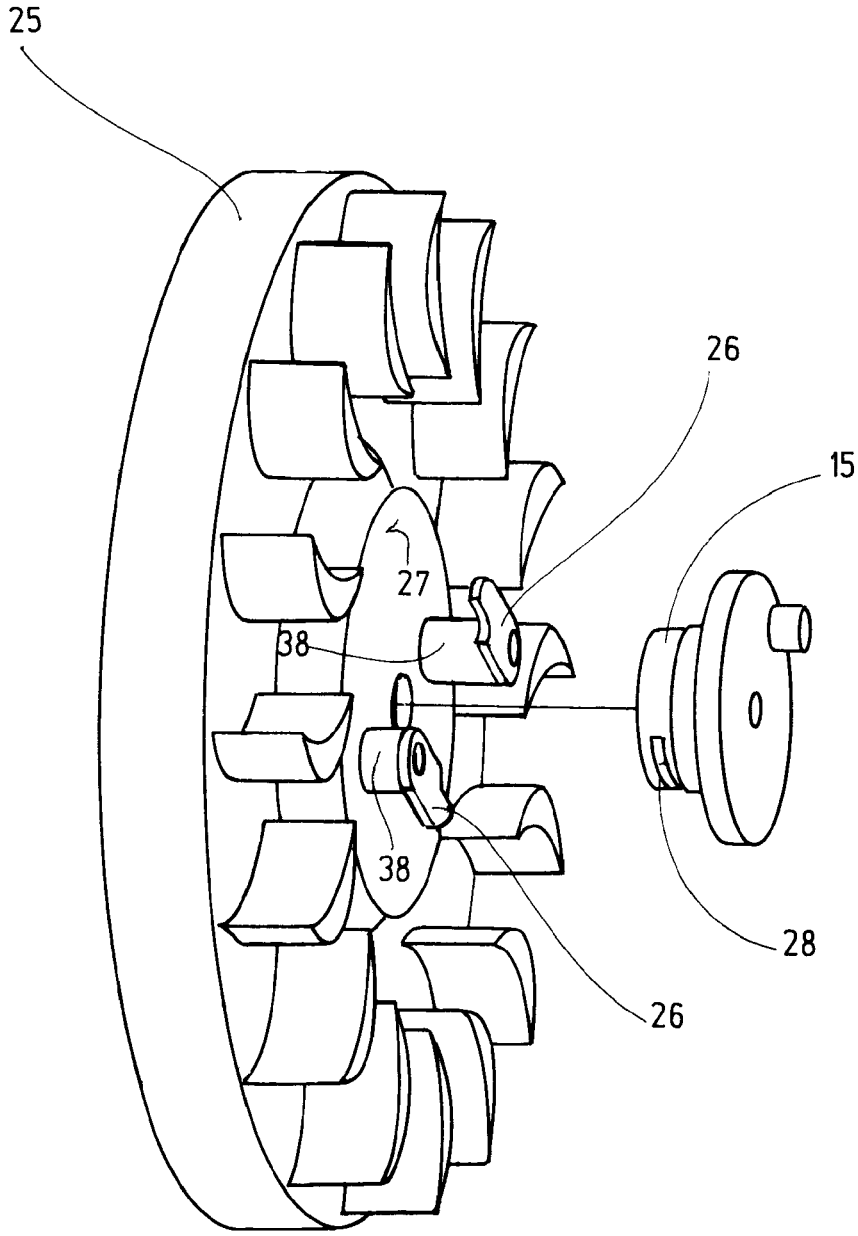
FIG. 5, a perspective representation of the crankshaft flange with a ratchet coupling for engaging a coupling member on the crankshaft flange.

FIG. 5 shows a perspective representation of the crankshaft flange 25. This flange features a plane side 27 that forms the side that points away from the internal combustion engine and toward the starter device 100. Blade elements are integrally moulded onto the circumference of the crankshaft flange 25 in order to ventilate the complete system consisting of the internal combustion engine and the starter device 100. Ratchet elements 26 with a different height referred to the plane side 27 are arranged on the plane side 27 of the crankshaft flange 25. The ratchet elements 26 are rotatably supported on cylinder members 38, wherein the cylinder members respectively have a different length. The cylinder members 38 are arranged on the plane side opposite of one another referred to the rotational axis of the crankshaft flange 25, wherein the first cylinder member 38 is shorter than the second cylinder member 38. The coupling member 15 features engagement windows 28, into which the ratchet elements 26 can engage. In order to assign one respective ratchet element 26 to a defined engagement window 28, the engagement windows 28 also have a different axial position in the direction of the rotational axis of the crankshaft flange 25. This ensures that the starter device 100 with the assigned torque characteristic corresponds to the correct compression or expansion phase of the internal combustion engine.

Figure 6:
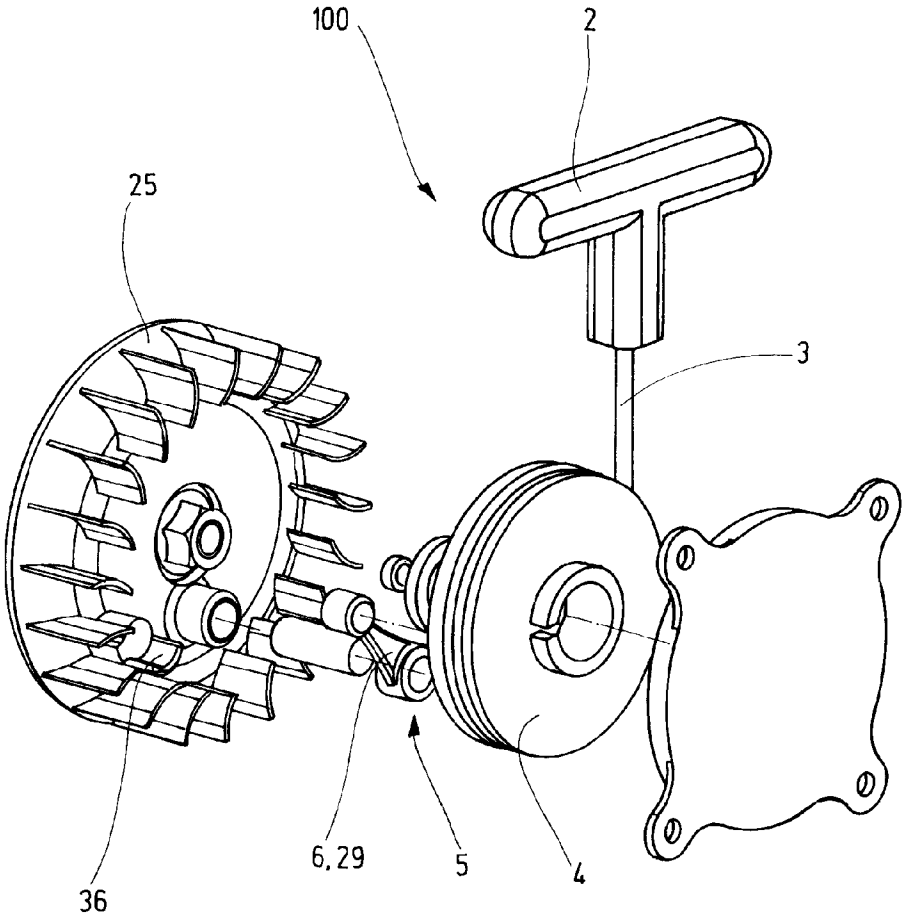
FIG. 6, an exploded view of a starter device with another embodiment of the double crank mechanism.
Figure 7:
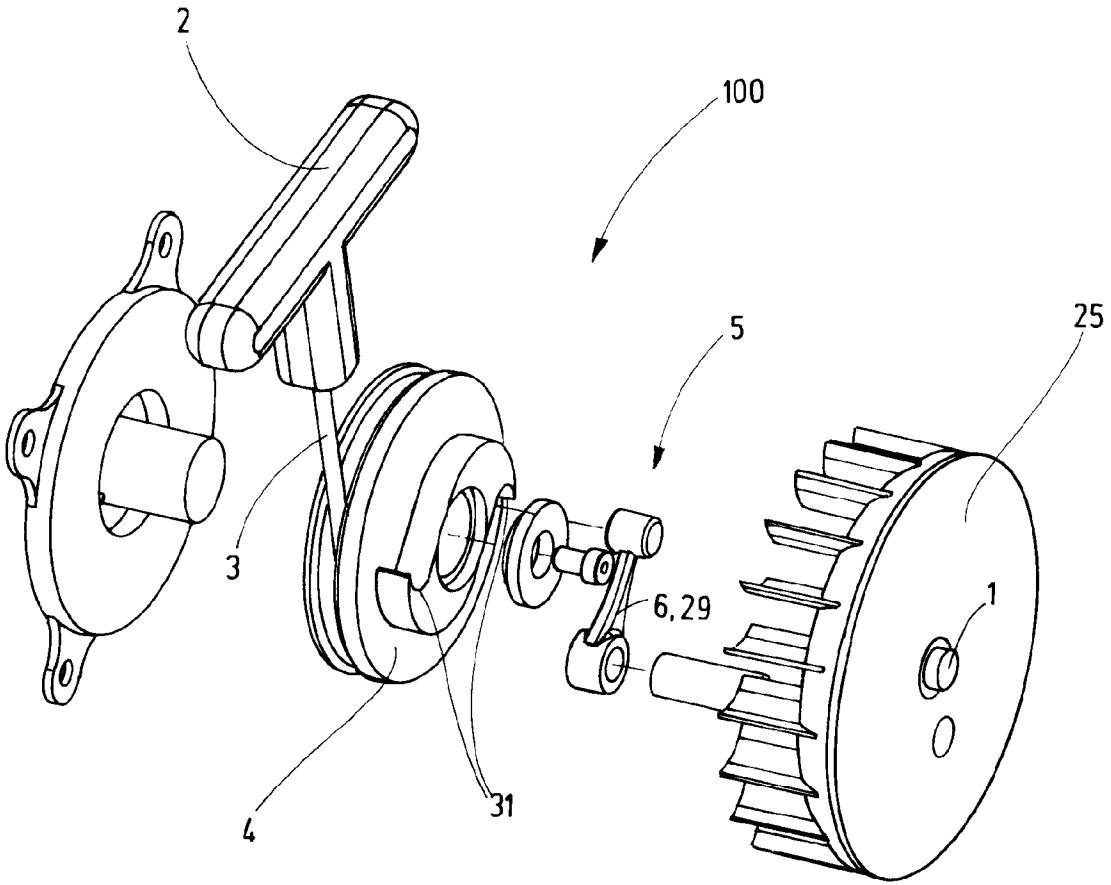
FIG. 7, the starter device according to FIG. 6 in the form of a view that is turned by 180°.

FIGS. 6 and 7 show another embodiment of the starter device 100.

A centrifugal clutch with a centrifugal element 29 is arranged between the pulling means spool 4 and the crankshaft flange 25 in such a way that the centrifugal element 29 acts as a coupling rod 6 and forms a double crank mechanism 5 together with the crankshaft flange 25 and the pulling means spool 4. One can ascertain that a joint socket geometry 31 is integrally moulded onto the pulling means spool 4 such that the centrifugal element 29 is driven by the joint socket geometry 31. If the crankshaft flange 25 rotates faster than the starter device 100 when the internal combustion engine starts, the centrifugal element 29 separates from the joint socket geometry 31 and turns radially outward due to the centrifugal force. The internal combustion engine or the crankshaft flange 25 therefore can rotate freely without the starter device 100 participating in this rotational movement. Therefore, the function of the double crank mechanism 5 is combined with the function of an overrunning clutch. A crankshaft 1 that is illustrated centrally in the crankshaft flange 25 points in the direction of the (not-shown) internal combustion engine in the form of a shaft end.

Figure 8:
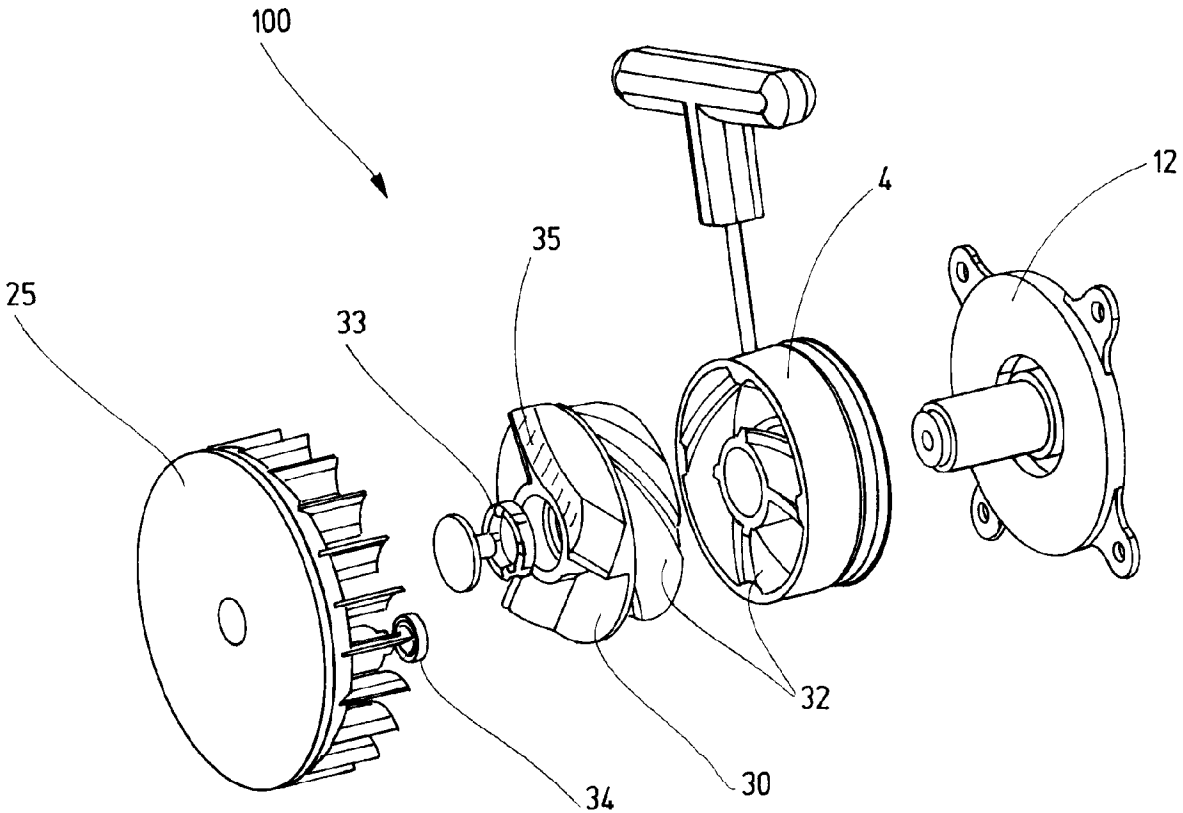
FIG. 8, an exploded view of another embodiment of a starter device with an engaging element that cooperates with the pulling means spool by means of a quick-acting screw thread.
Figure 10:
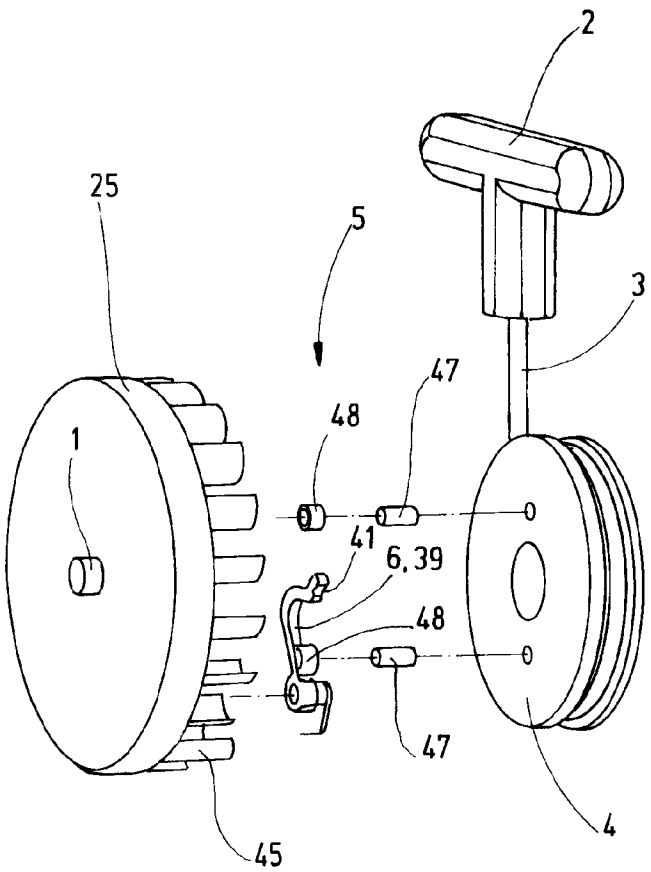
FIG. 10, the starter device according to FIG. 9 in the form of a view that is turned by approximately 60°.
Figure 9:
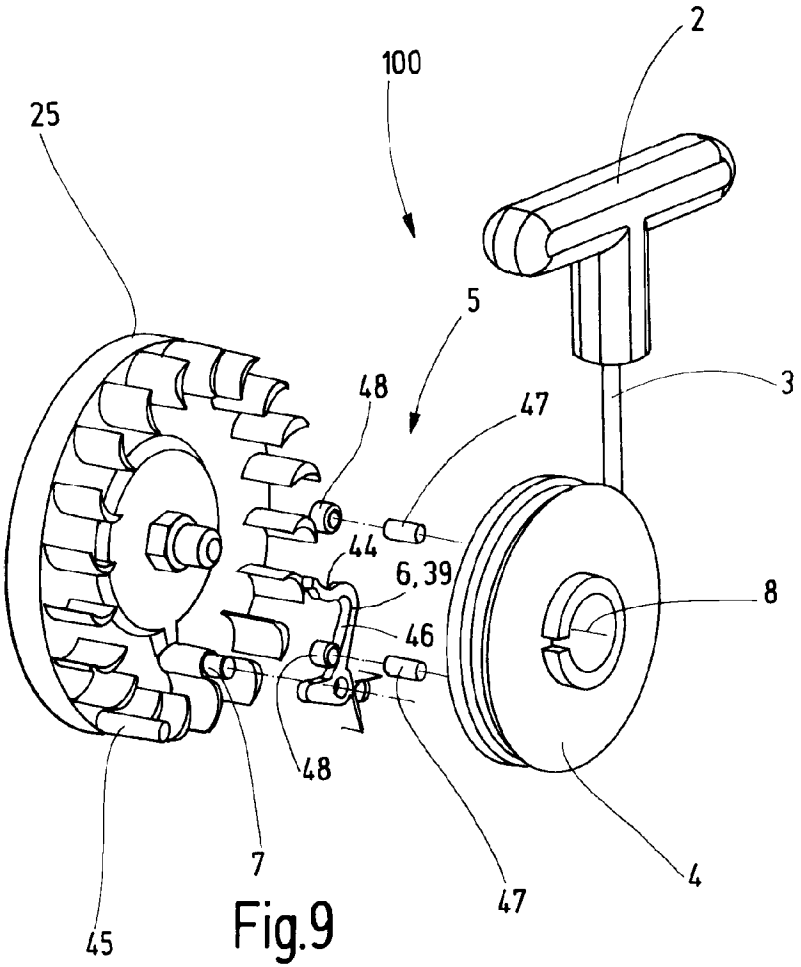
FIG. 9, an exploded view of a starter device with an embodiment of the cam roller gear.

FIG. 8 shows another perspective representation of the starter device 100 that extends between the receptacle plate 12 and the crankshaft flange 25. A friction ring 33 and a roll element 34 arranged between the engaging element 30 and the crankshaft flange 25 cooperate in such a way that a torque transmission takes place when the starter device 100 is actuated and this torque transmission is not interrupted until the internal combustion starts. The engaging element 30 comprises roll tracks 35 that are realized in the direction of the crankshaft flange 25, wherein 3 roll tracks are arranged on the circumference in a star-shaped configuration and angularly spaced apart by 120°. The roll tracks 35 serve for the rolling motion of a roll element 34, with the roll tracks 35 extending with a radial curvature. The engaging element 30 and the pulling means spool 4 furthermore comprise a quick-acting screw thread 32 that connects both components such that they can be screwed relative to one another. The axial position of the engaging element 30 relative to the pulling means spool 4 is related to a defined rotatory position due to the quick-acting screw thread 32 such that the roll element 34 rolls on the roll track 35 in dependence on the rotatory position of the engaging element 30. This results in a different torque characteristic between the pulling means spool 4 and the crankshaft flange 25 in order to create a functional connection according to the present invention, in which the crankshaft torque introduced into the crankshaft 1 is variable in dependence on the rotational angle of the crankshaft at a constant torque in the pulling means spool 4.

The design of the invention is not limited to the above-described embodiments. On the contrary, it would be conceivable to realize a multitude of variations that also utilize the described solution in fundamentally different types of designs.

FIGS. 9 to 22 show another embodiment of the starter device 100. A centrifugal clutch with a centrifugal element 39 is arranged between the pulling means spool 4 and the crankshaft flange 25 in such a way that the centrifugal element 39 acts as a roll track and forms a cam roller gear together with the crankshaft flange 24 and the pulling means spool 4. In this case, the roll track lever 39 is supported on the hinge pin 7 in a rotatable and pivoted fashion and held in the idle position shown in one of FIGS. 11 (top view) and 12 (perspective representation), in which the first contact section 41 of the roll track lever 39 is still supported on the limit stop 42 of the coupling flange 25, by means of the pull-back spring 40. After the internal combustion engine starts, the disengaging weight 43 of the roll track lever 39 displaces the roll track lever 39 into the operating position "engine running" shown in FIGS. 13 (top view) and 14 (perspective representation) and the second contact section 44 of the roll track lever 39 contacts the limit stop bolt 45 on the crankshaft flange 25. During the starting process, the roll track section 44 of the roll track lever 39 contacts one of the two stopping bolts 47 arranged on the pulling means spool 4 such that the roll 48 arranged on each stopping bolt 47 rolls on the roll track section 44 and thusly transmits the starter torque. The roll track lever 39 has a contour referred to the roll track section 46 that corresponds to the optimal change in the transmission ratio of the double crank mechanism 5 in dependence on the rotational angle of the crankshaft. The roll track lever 39 also has a width that corresponds to the respective moments and forces to be transmitted. The contour of the roll track lever 39 preferably is continuously tapered referred to its width from the hinge pin 7 up to the second contact section 44.

In order to ensure an early engagement or an early contact between the stopping bolt 47 and the roll track lever 39 with respect to the rope path, two stopping bolts 47 are provided, wherein the limit stop bolt 45 respectively makes contact in the roll track section 46 of the roll track lever 39 and the other stopping bolt 47 pivots the roll track lever 39 inward once again when the engine is running and the crankshaft flange 25 "passes" the pulling means spool 4.

Figure 11:
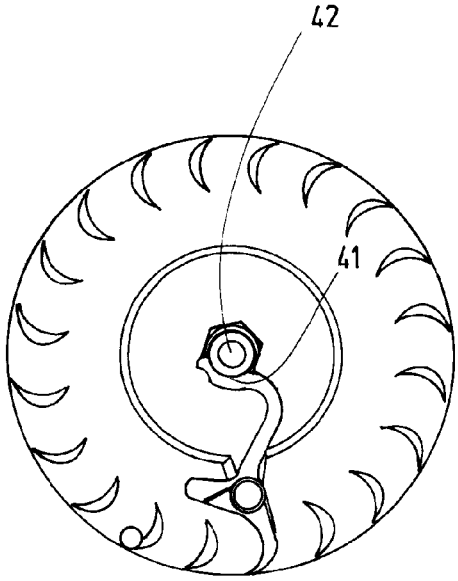
FIGS. 11 to 22, representations of the fan wheel and of the pivoted lever with the drive shaft of the starter device according to FIG. 9 in different operating positions.
Figure 12:
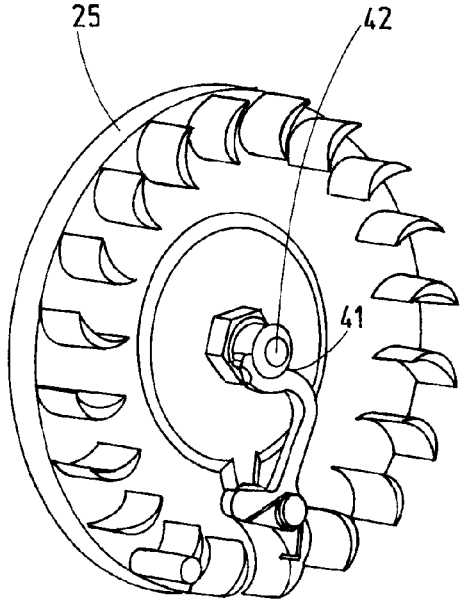
Figure 13:
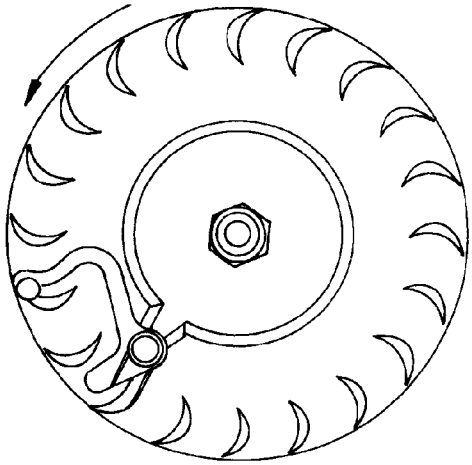
Figure 14:
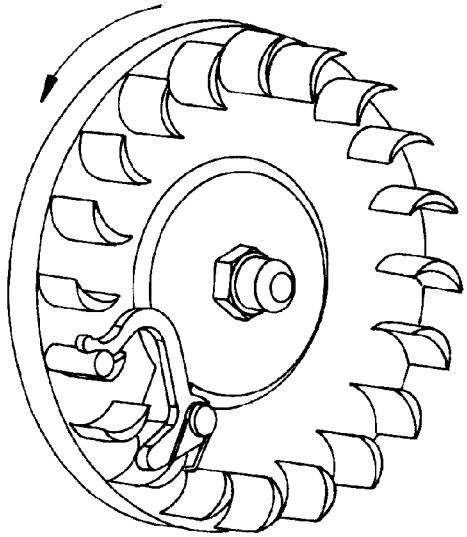

FIGS. 11 and 12 show the operating situation in the "idle position," and FIGS. 13 and 14 show the operating situation "engine running."

Figure 16:
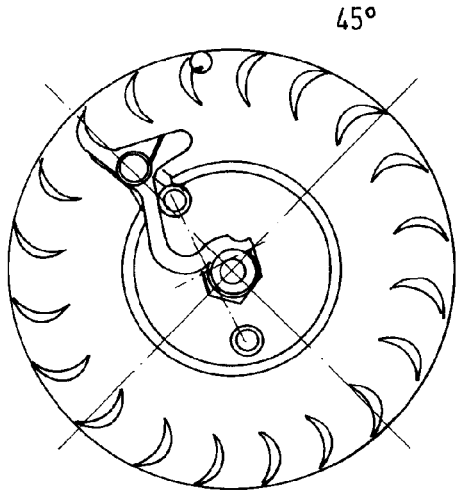
Figure 17:
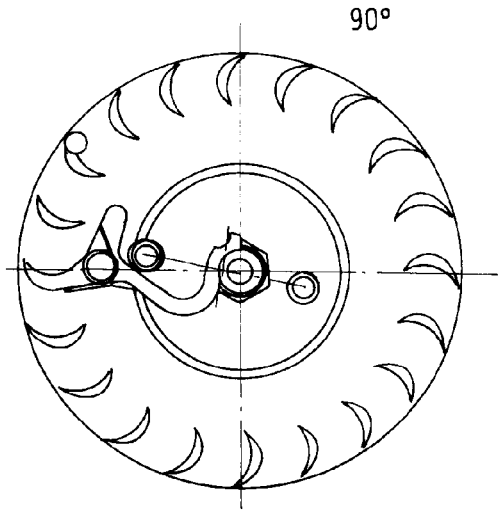
Figure 18:
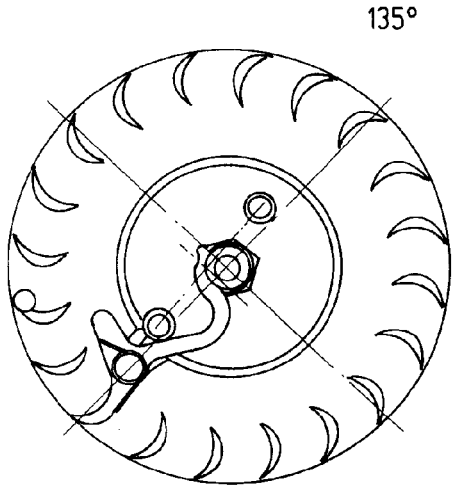
Figure 19:
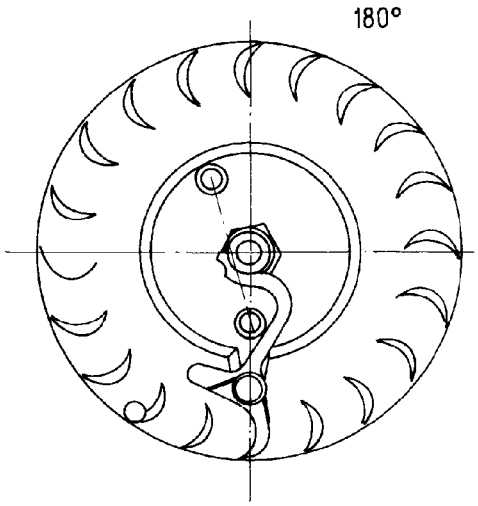
Figure 20:
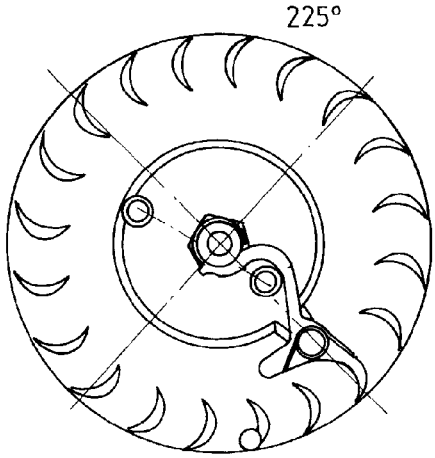
Figure 21:
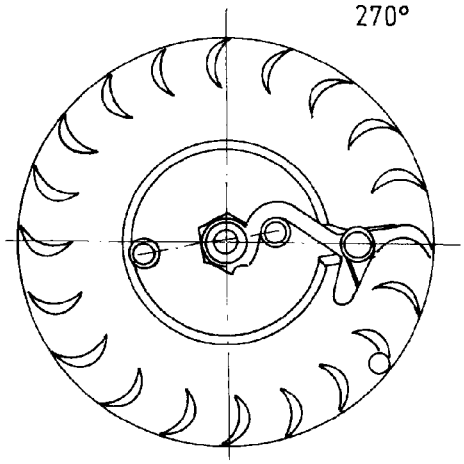
Figure 22:
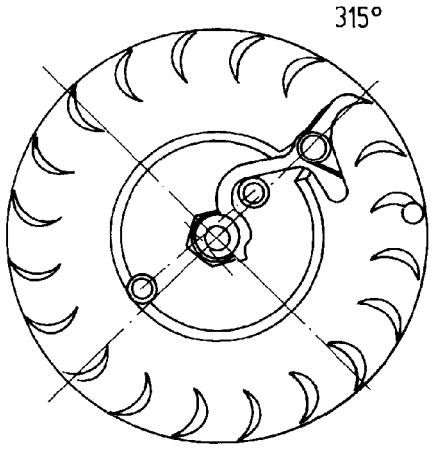

During the course of one respective revolution of the pulling means spool 4 on one hand and the crankshaft flange 25 on the other hand, the coupling gear 5 causes a relative movement that results in different distances A between the contact point B of the limit stop bolt 45 on the roll track section 46 of the roll track lever 39 and the spool axis 8 such that a transmission ratio is achieved that varies over 360° with respect to the torque to be transmitted and the resulting speed. The individual prominent operating points during one revolution are illustrated in FIGS. 15 to 22, wherein FIG. 15 shows the operating situation at 0°/360°, FIG. 16 shows the operating situation at 45°, FIG. 17 shows the operating situation at 90°, FIG. 18 shows the operating situation at 135°, FIG. 19 shows the operating situation at 180°, FIG. 20 shows the operating situation at 225°, FIG. 21 shows the operating situation at 270°, and FIG. 22 shows the operating situation at 315°.

Figure 15:
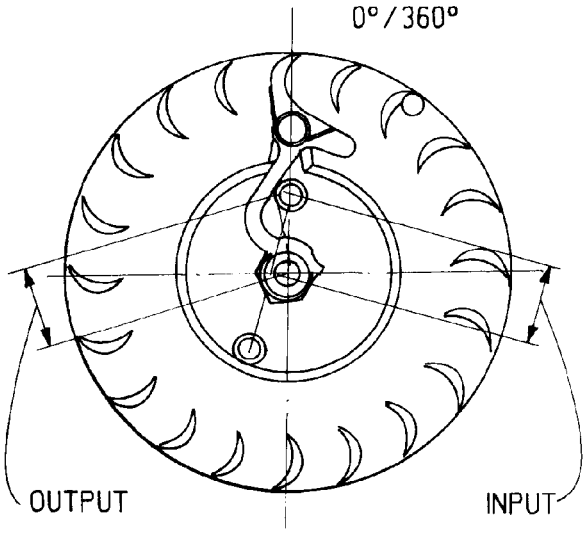

FIG. 15 indicates in an exemplary fashion that the transmission ratio i results from the ratio between I output and I input and according to the formula $$i = \frac{I_{output}}{I_{input}}$$

In the described example, this results in $$i \approx \frac{32\,\text{mm}}{31\,\text{mm}} \approx 1{,}03.$$

The following transmission ratios result for the other angular positions:

$$45^\circ \quad i \approx \frac{37\,\text{mm}}{31\,\text{mm}} \approx 1{,}19$$

$$90^\circ \quad i \approx \frac{39\,\text{mm}}{31\,\text{mm}} \approx 1{,}26$$

$$135^\circ \quad i \approx \frac{39\,\text{mm}}{33\,\text{mm}} \approx 1{,}18$$

$$180^\circ \quad i \approx \frac{32\,\text{mm}}{33\,\text{mm}} \approx 0{,}97$$

$$225^\circ \quad i \approx \frac{27\,\text{mm}}{33\,\text{mm}} \approx 0{,}82$$

$$270^\circ \quad i \approx \frac{25\,\text{mm}}{32\,\text{mm}} \approx 0{,}78$$

$$315^\circ \quad i \approx \frac{28\,\text{mm}}{33\,\text{mm}} \approx 0{,}85$$

$$360^\circ \quad i \approx \frac{32\,\text{mm}}{31\,\text{mm}} \approx 1{,}03.$$

Figure 23:
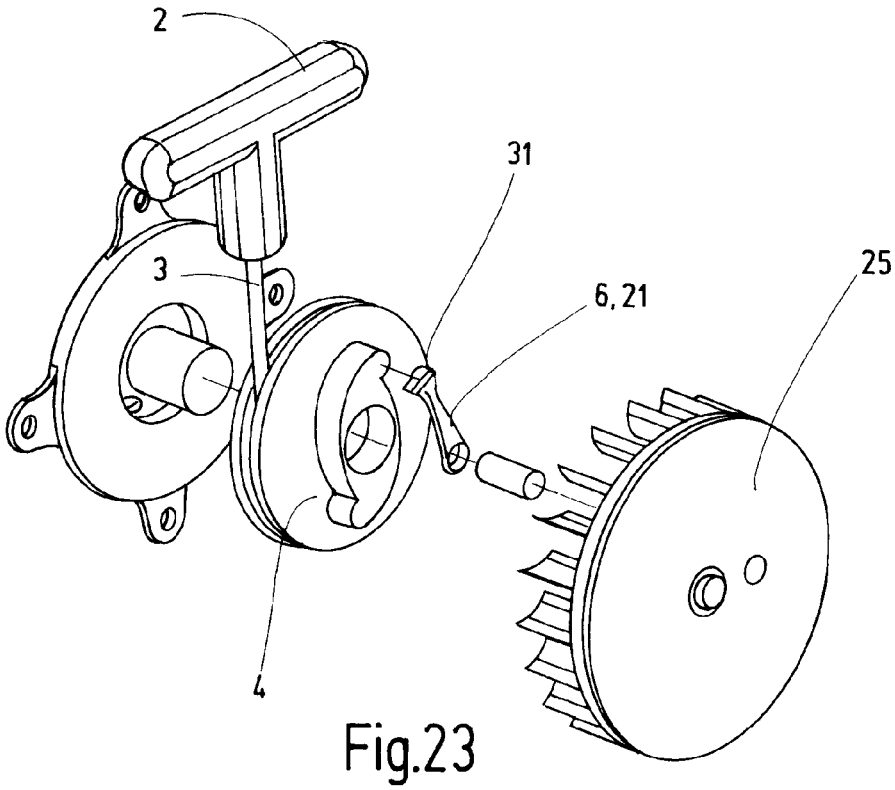
FIG. 23, an exploded view of a starter device with another embodiment of the double crank mechanism.
Figure 24:
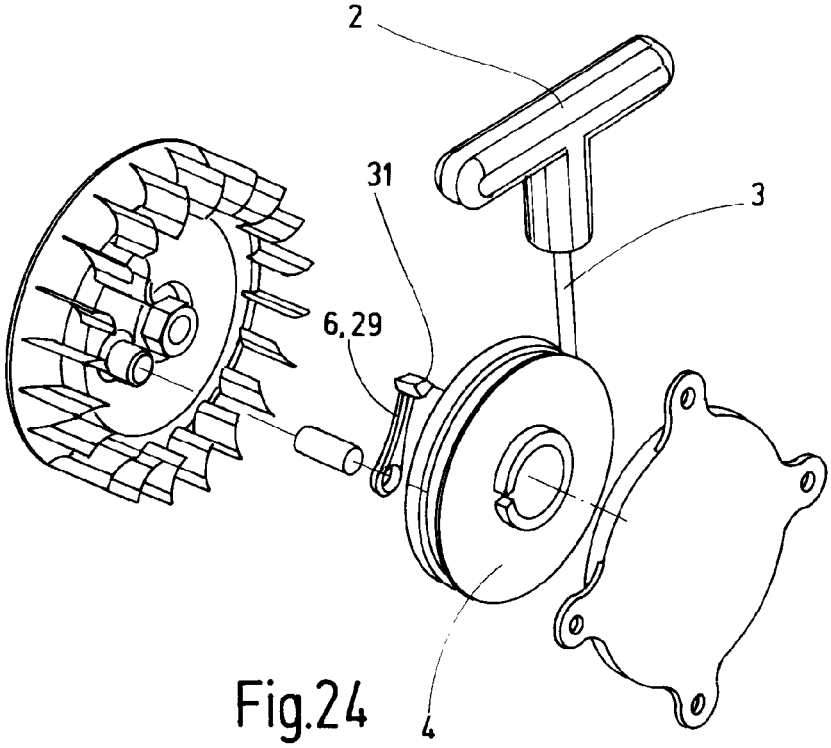
FIG. 24, the starter device according to FIG. 23 in the form of a view that is turned by 180°, and FIG. 25, a diagram with the transmission ratios and the torque demand in dependence on the crankshaft angle.

FIGS. 23 and 24 shows another embodiment of the starter device 100 that largely corresponds to the embodiment shown in FIGS. 6 and 7. Identical components are also identified by the same reference symbols. The difference between these embodiments can be seen in that the joint socket is not moulded onto the pulling means spool 4, but rather onto the centrifugal element (coupling rod) 6. Consequently, the joint ball and the joint socket are merely interchanged. This provides the option of using one (or more) bolt(s) inserted into the pulling means spool as the joint ball.

Figure 25:
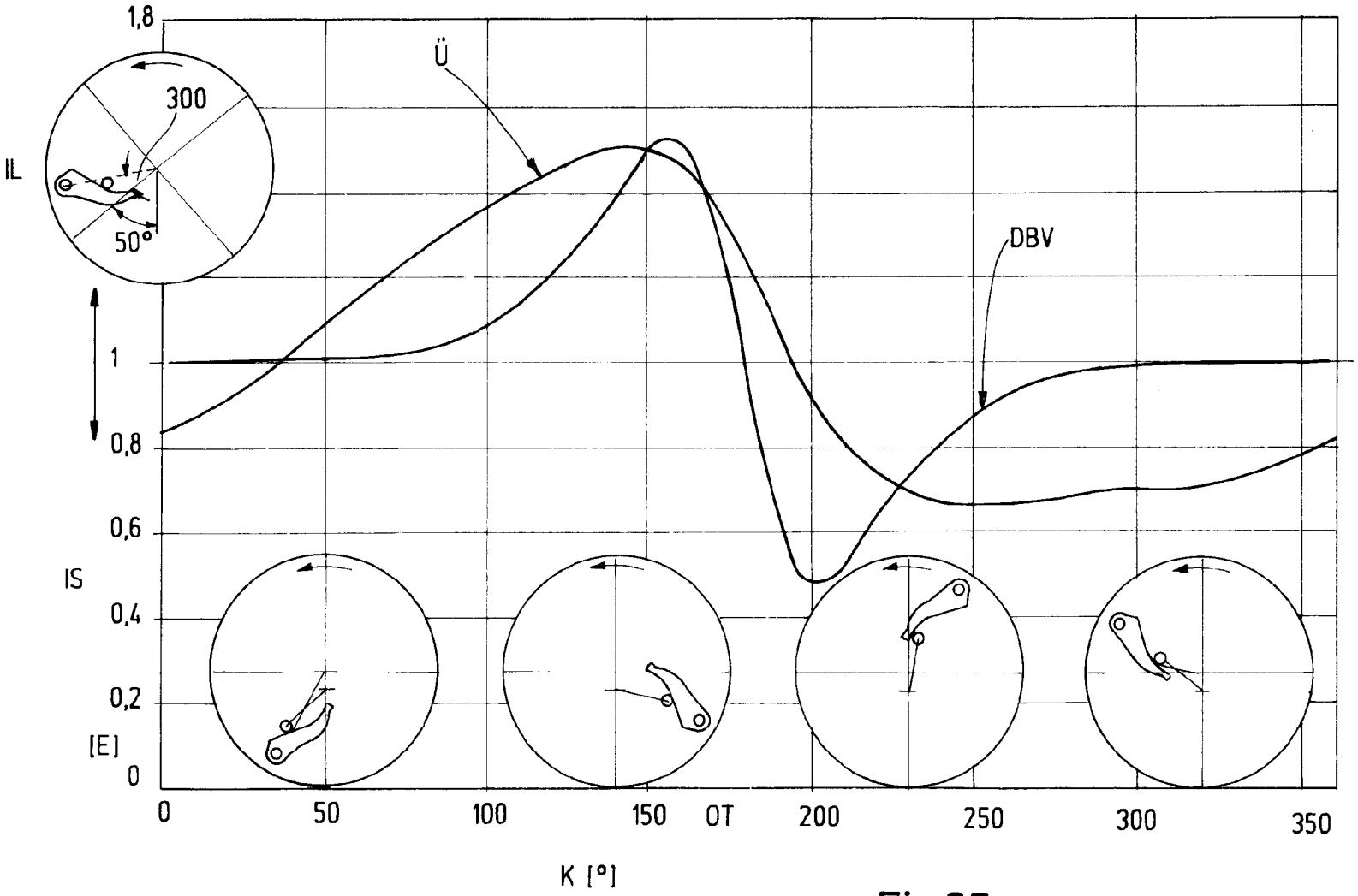

FIG. 25 shows a diagram with the transmission ratios Ü and the torque demand in dependence on the crankshaft angle K. The round drawings of the gear illustrated in this figure do not correspond to the drawings according to FIGS. 9-22, but merely serve as schematic representations. In this case, a step-down transmission ratio (IL) is illustrated above the line L (torque equal to zero) and a step-up transmission ratio (IS) is illustrated below said line.

The torque demand characteristic (DBV) was qualitatively calculated from the gas forces.

The invention claimed is:

1. A device for starting an internal combustion engine for handheld equipment including chain saws, lawn mowers, and lawn trimmers, or vehicles including mopeds, boats or miniature aircraft, comprising:

an output element into which a starter torque is introduced when the starting device is actuated, wherein the output element is formed by a pulling means spool that generates a variable rotational speed when a starter pulling means is uniformly unwound from the pulling means spool; and a functional connection comprising a gear unit arranged between the pulling means spool and a crankshaft of the internal combustion engine in order to introduce a crankshaft torque therein, wherein the gear unit is formed as a cam roller gear having a coupling element and transmits the starter torque of the pulling means spool to the crankshaft with a step-up or step-down ratio that varies depending upon the rotational angle of the crankshaft, said coupling element comprising a roll track lever and a centrifugal clutch, said roll track lever introducing a variable crankshaft torque into the crankshaft depending on the rotational angle of the crankshaft at a constant starter torque in the pulling means spool and said centrifugal clutch releasing the pulling means spool from the crankshaft after the internal combustion engine has started.

2. The starting device according to claim 1, characterized in that the starting device is manually operated and comprises a handle, the starter pulling means arranged on the handle and the pulling means spool for winding up and unwinding the starter pulling means in order to introduce the starter torque into the crankshaft of the internal combustion engine.

3. The starting device according to claim 1, characterized in that a low transmission ratio is adjusted in the gear unit during the compression stroke of the internal combustion engine and a high transmission ratio is adjusted in the gear unit during the expansion stroke of the internal combustion engine.

4. The starting device according to claim 1, characterized in that the starter pulling means comprises a pull rope or a pull band and the pulling means spool comprises a rope spool or a band spool, wherein the rope or the band forms layers that lie on top of one another on the spool.

5. The starting device according to claim 1, characterized in that the gear unit comprises a gearing with varying transmission ratio.

6. The starting device according to claim 1, characterized in that the pulling means spool has an out-of-round, elliptical or cam-like contour for winding up and unwinding the starter pulling means.

7. The starting device according to claim 1, characterized in that the roll track lever that contacts a stopping bolt in order to transmit the rotational movement of the pulling means spool to the crankshaft.

8. The starting device according to claim 1, characterized in that the starting device comprises an electric motor for introducing the starter torque into the output element.

* * * * *